US005787810A

United States Patent [19]

Stephan

[11] Patent Number: 5,787,810

[45] Date of Patent: Aug. 4, 1998

[54] SHEET-GUIDING SYSTEM FOR A PRINTING PRESS

[75] Inventor: Günter Stephan, Wiesloch-Baiertal, Germany

[73] Assignee: Heidelberger Druckmaschinen AG, Heidelberg, Germany

[21] Appl. No.: 760,660

[22] Filed: Dec. 9, 1996

[30] Foreign Application Priority Data

Dec. 9, 1995 [DE] Germany ..... 195 46 046.4

[51] Int. Cl.[6] ..... B41F 13/24

[52] U.S. Cl. ..... 101/232; 101/409; 101/420; 271/195

[58] Field of Search ..... 101/230, 231, 101/232, 420, 183, 148, 409, 424.1, 410; 271/188, 194, 195

[56] References Cited

U.S. PATENT DOCUMENTS

| | | | |
|---|---|---|---|
| 3,986,455 | 10/1976 | Jeschke et al. | 101/409 |
| 4,395,949 | 8/1983 | Jeschke | 101/420 |
| 4,572,071 | 2/1986 | Cappel et al. | 101/183 |
| 5,209,160 | 5/1993 | Smith | 101/148 |
| 5,419,254 | 5/1995 | DeMoore et al. | 101/420 |
| 5,488,905 | 2/1996 | Selor | 101/420 |
| 5,520,382 | 5/1996 | Nakajima | 271/188 |
| 5,546,858 | 8/1996 | Stephan | 101/232 |

FOREIGN PATENT DOCUMENTS

| | | |
|---|---|---|
| 0 647 524 A1 | 4/1995 | European Pat. Off. . |
| 43 42 203 A1 | 6/1995 | Germany . |
| 229 202 | 1/1944 | Switzerland . |

*Primary Examiner*—Eugene H. Eickholt

*Attorney, Agent, or Firm*—Herbert L. Lerner; Laurence A. Greenberg

[57] ABSTRACT

A sheet-guiding system for a printing press, the sheet-guiding system being disposed in the vicinity of a transfer drum located between two sheet-guiding cylinders, respectively, disposed upstream and downstream of the transfer drum, as viewed in a sheet travel direction, the transfer drum being provided with rows of grippers movable along a travel path and having at least nearly closed surfaces between the rows of grippers, including an air guide element disposed above the transfer drum at a slight spacing from the travel path of the gripper rows, the air guide element defining an air chamber at the top thereof, the air chamber extending from the upstream to the downstream sheet-guiding cylinder, and a blower device for applying air to the air chamber in a direction towards the downstream sheet-guiding cylinder.

24 Claims, 5 Drawing Sheets

31
32
33
34
35
36
12
12'
28
40
41
42
42'
43
44
45
46
48

SHEET-GUIDING SYSTEM FOR A PRINTING PRESS

BACKGROUND OF THE INVENTION

Field of the Invention

The invention relates to a sheet-guiding system for a printing press, which is disposed in the vicinity of a transfer drum located between two sheet-guiding cylinders, respectively, disposed upstream and downstream of the transfer drum, as viewed in a sheet travel direction, the transfer drum being provided with rows of grippers and having closed or virtually closed surfaces between the rows of grippers, the sheet-guiding system including at least one blower device.

In sheet-fed printing presses, the sheets are guided through the press by drums and cylinders. The leading edge of a sheet is passed on from one row of grippers to the next. For good print quality, clean, flutter-free guidance of the sheets without smearing of the printing surfaces is essential.

The published German Patent Document DE 43 42 203 Al proposes the construction of a sheet-guiding system of the type referred to in the introduction hereto wherein a sheet surrendered by the upstream cylinder to the transfer drum is acted upon by air from above, i.e., in the direction of the sheet transfer, by a blower device. In addition, a hot-air blade for drying the sheets is assigned to the upstream cylinder. After the transfer of a sheet to the downstream cylinder, this published German patent document proposes the disposition of additional air blades for sheet guidance.

With the blower device which acts upon the sheets being fed from top to bottom, the danger arises that the application of air in conjunction with gravity may cause a crumpling of the sheet. This happens especially with soft flexible printing materials, which results in the formation of folded-over, stuck-together sheets. Because this blower device has only a slight drying effect, an additional hot air blade is provided for drying. Moreover, the air blades assigned to the downstream cylinder are required to assure good sheet guidance there as well. A suction box disposed below the sheet-guiding cylinder exhausts or removes the air by suction in this sheet-guiding system. However, this air exhaustion or removal can cause sliding friction between the sheet and the guiding upper surface of the suction box, with a consequential formation of scratches on the rear side of the sheet. This is especially disadvantageous when sheets are printed on both sides. The suction-removal or exhaustion openings are cyclically closed by the transfer drum upon the rotation of the transfer drum whenever the two gripper systems face one another horizontally. Moreover, the sheet constantly covers the greatest portion of suction removal openings. No steady air flow can thereby arise. The moisture extracted from the sheet increases in the air and remains inside the press room. The blown-in air becomes turbulent, is saturated with moisture, and is more likely to be removed randomly from the press. Because no targeted or sought-after flows of material (air, moisture, solvent, and so forth) are formed, the drying results and the sheet guidance remain dependent upon random factors.

The aforedescribed sheet-guiding system is moreover greatly complicated and expensive, and requires a high energy consumption.

SUMMARY OF THE INVENTION

It is accordingly an object of the invention to provide a relatively simply constructed sheet-guiding system of the type referred to in the introduction hereto wherein, through targeted flows of material, the sheet guidance and, if drying between the printing units is contemplated, the drying is improved for a reduced energy consumption.

With the foregoing and other objects in view, there is provided, in accordance with the invention, a sheet-guiding system for a printing press, the sheet-guiding system being disposed in the vicinity of a transfer drum located between two sheet-guiding cylinders, respectively, disposed upstream and downstream of the transfer drum, as viewed in a sheet travel direction, the transfer drum being provided with rows of grippers movable along a travel path and having at least nearly closed surfaces between the rows of grippers, comprising an air guide element disposed above the transfer drum at a slight spacing from the travel path of the gripper rows, the air guide element defining an air chamber at the top thereof, the air chamber extending from the upstream to the downstream sheet-guiding cylinder, and a blower device for applying air to the air chamber in a direction towards the downstream sheet-guiding cylinder.

In accordance with another feature of the invention, an air outlet opening is provided between the air guide element and the upstream sheet-guiding cylinder.

In accordance with a further feature of the invention, the blower device is disposed on the air guide element.

In accordance with an added feature of the invention, the blower device is adjustably oriented with respect to the downstream sheet-guiding cylinder.

In accordance with an additional feature of the invention, the sheet-guiding system includes a heating source for heating the air applied to the air chamber so as to aid in drying the air.

In accordance with yet another feature of the invention, at least part of the travel path of the gripper rows is in a lower region of the transfer drum, and a sheet-guiding device extends from the upstream sheet-guiding cylinder to the downstream sheet-guiding cylinder along the part of the travel path of the gripper rows in the lower region of the transfer drum.

In accordance with yet a further feature of the invention, the sheet-guiding device is a closed guide baffle.

In accordance with yet an added feature of the invention, the sheet-guiding device is formed with air inlet openings for effecting a flotation guidance of a respective sheet.

In accordance with yet an additional feature of the invention, the sheet-guiding system includes an air guiding device aligned in a direction towards the upstream sheet-guiding cylinder, the air guiding device being disposed below the air guide element and between the travel path of the gripper rows and the upstream sheet-guiding cylinder.

In accordance with still another feature of the invention, the air guiding device is formed of baffles disposed parallel to the air guide element, the baffles being formed with bent end portions directed towards the upstream sheet-guiding cylinder.

In accordance with a still further feature of the invention, the air guide element is formed with a bent portion directed towards the upstream sheet-guiding cylinder.

In accordance with still an added feature of the invention, the air guiding device is formed as a laminated grid.

In accordance with still an additional feature of the invention, the sheet-guiding system includes an additional blower device oriented in a direction towards the upstream sheet-guiding cylinder and disposed below the air guide element between the travel path of the gripper rows and the upstream sheet-guiding cylinder.

In accordance with another feature of the invention, the air outlet opening is formed as an air outlet channel.

In accordance with a further feature of the invention, the sheet-guiding system includes a dryer disposed in the air outlet channel.

In accordance with an added feature of the invention, the dryer is a radiant dryer.

In accordance with an additional feature of the invention, the dryer has a blower.

In accordance with yet another feature of the invention, the transfer drum has lateral sealing disks.

In accordance with yet a further feature of the invention, a footboard is located at the top of the sheet-guiding system.

In accordance with yet an added feature of the invention, the footboard is simultaneously an air guide element.

In accordance with yet an additional feature of the invention, the footboard is formed with an opening serving as an air inlet leading to the blower device.

In accordance with another feature of the invention, an air outlet opening is located between the air guide element and the upstream sheet-guiding cylinder, and the footboard is formed with an air outlet downstream from the air outlet opening.

In accordance with a concomitant feature of the invention, the air outlet opening is in communication with the blower device for feeding thereto air emerging from the air outlet opening.

The object of the invention is attained by an air guide element being disposed above the transfer drum, spaced slightly from the travel path of the gripper rows, the air guide element nearly closing off, at the top, an air chamber extending from the upstream to the downstream sheet-guiding cylinder, except for an air outlet opening located between the air guide element and the upstream sheet-guiding cylinder, and a blower device applying air to the air chamber in a direction towards the downstream sheet-guiding cylinder.

The invention offers the advantage that, with little mechanical engineering effort or expense, the air of the blower device mentioned at the introduction hereto is used many times. It is first used for blowing onto the sheet transferred to the downstream sheet-guiding cylinder and, thereafter, this blown air is deflected in a direction towards the upstream sheet-guiding cylinder, so as to attain secure sheet guidance there as well. In addition, the dragging action of the upstream sheet-guiding cylinder is utilized. Thereafter, some of the blown air further serves as supporting air for the guidance of the sheet fed by the transfer drum.

Due to the disposition of the air guide element, the transfer drum, with the surfaces thereof, achieves an action similar to that of a circular piston and thus reinforces the aforementioned application of air. The transfer process can be divided into four work cycles of the air-supported sheet guidance.

I. Blowing-in of air and compression of the air above the sheet.

II. Opening of the air inlet chamber and maintenance of the pressure level by developing equilibrium between the blown-in air and the overflowing air.

III. Splitting or division of the air into a waste air flow, which escapes to the waste air openings, and a supporting air flow rerouted inside the drum space.

IV. Rerouting of sheets with the aid of the supporting air flow in the drum interior and simultaneous positive outward displacement of the waste air flow as a consequence of the drum rotation.

With a single blower device, a reliable and good sheet guidance can thereby be attained on the upstream sheet-guiding cylinder, on the transfer drum and on the downstream sheet-guiding cylinder. Moreover, it is possible to achieve the drying of sheets between two printing units by heating the air blown in for sheet guidance and because a material flow of air, moisture and dissolved ingredients is produced from the aforementioned work cycles, the material flow, above the sheet, constantly maintaining a moisture gradient which extracts moisture from the sheet and carries it out of the press via the guiding air, while the sheet emerges dry from the transfer region.

At the transfer drum, the sheets are padded or lined, from below, with supporting air so that fluttering movements are prevented, or at least the oscillations are greatly damped. This is achieved by having the surface of the transfer drum and the sheet form a closed chamber wherein the air is compressed. A force therefore always acts upon the printed side of the sheet in the region of the sheet-guiding system, so that reliable sheet guidance is attained.

In addition to these advantages, a countercurrent region arises at the upstream sheet-guiding cylinder, this region, if necessary, having a high drying effect. An outflow of the moist air takes place, and the drier air is utilized as sheet-supporting air, which assures reliable sheet guidance in the region of the transfer drum and, simultaneously, further dries the sheet. Upon the transfer of the sheet to the downstream sheet-guiding cylinder, fresh air is blown onto the sheet and the supporting air and the fresh air are made turbulent, once again, a high drying effect being attained. Because of the disposition of the blower device, only dry air can be aspirated from outside the press. These advantageous effects are described hereinafter in further detail in conjunction with the drawings.

The blower device is suitably disposed so that it blows counter to the sheet travel direction and in the direction towards the downstream sheet-guiding cylinder. To that end, the blower device may be disposed on the air guide element, and it is additionally advantageous if the blower device is adjustable as to the orientation thereof towards the downstream sheet-guiding cylinder. In this way, the blower device can be optimized as a function of the materials to be printed. It is obvious, however, that other arrangements of the blower device are also conceivable. For example, the blower device can also be disposed on the transfer drum. In that case, the blowing of air takes place, in accordance with the operating cycle of the press, as a function of the phase position of the transfer drum.

A further improvement in sheet guidance in the vicinity of the transfer drum can be attained by having a sheet-guiding device extend from the upstream sheet-guiding cylinder to the downstream sheet-guiding cylinder along the travel path of the gripper rows, in the lower region of the transfer drum.

This sheet guiding device may be constructed as a closed or substantially closed guide baffle. However, it is also possible to provide the sheet guiding device with air inlet openings and, in this way, achieve a flotation guidance of the sheet. Any contact of the sheet with the guiding surface of the sheet-guiding device can thereby be reliably precluded even in the case of hard-to-handle materials which are to be printed.

An improvement in sheet guidance on the upstream sheet-guiding cylinder is attained by disposing an air guiding device aligned in the direction towards the upstream sheet-guiding cylinder below the air guide element between the travel path of the gripper rows and the upstream sheet-guiding cylinder. The air guiding device may include baffles located parallel to the air guide element, as laminated wire grids or guide grids and as guide channels, respectively. This creates a turbulence-free laminar air flow, which assures a reliable application of a sheet to the upstream sheet-guiding cylinder. If the ends of horizontally extending baffles of the air guiding device are provided with angled or bent portions directed towards the upstream sheet-guiding cylinder, the blowing of air against the sheet is then further intensified. Such a bent portion may also be provided on the end of the air guide element, which achieves a like effect.

For especially intensive blowing of air onto the sheets on the upstream sheet-guiding cylinder and for an intensive air circulation for drying purposes, an additional blower device may be provided which is oriented in the direction towards the upstream sheet-guiding cylinder, and is disposed below the air guide element, between the path of motion of the gripper rows and the upstream sheet-guiding cylinder.

A further reinforcement of the blowing action at the upstream sheet-guiding cylinder can be attained by forming the air outlet opening as an air outlet channel. The air for the blowing action is further compressed, and the region of air application of the upstream sheet-guiding cylinder is enlarged further.

A dryer which intensifies the drying can be disposed in this air outlet channel. It can be constructed as a radiant dryer with ultraviolet or infrared irradiation, or as a dryer which blows onto the sheets with additional dry and, optionally, also warm air. Naturally, the two types of dryers may also be combined.

It is important that the air chamber which the air guide element closes off at the top be as closed as possible. To that end, provision may be made for the spacing of the drums and cylinders from the side wall to be as slight as possible, or a better closure of this space can be attained by equipping the transfer drum with lateral sealing disks. Optionally, additional wall elements or elevations of the side walls can be provided, which form, with these lateral sealing disks, a relatively tight closure having only narrow gaps which are required for the rotation of the parts.

A further embodiment provides that the air outlet and the air inlet communicate with one another for guiding air circulation. However, if sheet drying is also to be attained, it is then advantageous to provide equipment disposed between the air outlet and the air inlet for extracting the air moisture. Such an embodiment should be provided especially if inks or colors are being processed which contain not only the moisture but also solvent which must be prevented from getting into the workroom.

Better removal of the moist air and better feeding of the driest possible air are served by a further feature, which provides for an air inlet leading to the blower device to extend inwardly into the printing press, and an air outlet downstream of the air outlet opening to lead out of the printing press. The air inlet and the air outlet may be formed, for example, by openings in a footboard, preferably, in the form of grids. Such a footboard, of the type disposed between the printing units of a multicolor printing press, can also simultaneously act as an air guide element.

It is also, however, possible to provide that the air outlet not be discharged into the workroom, but rather, to the outside atmosphere, instead. The option of this type of controlled elimination of the waste air is possible because of the closed chamber formed by the device according to the invention. This is a further, major advantage of the invention because, in this way, the health conditions in the workrooms can be improved, and the waste air can be fed to a suitable cleaning system.

In the case of sheet drying, it proves to be especially advantageous if the blown-in air for sheet guidance is heated, or if the sheet guidance is accomplished by means of hot air. To that end, it is equally possible to supply hot air or to heat the sheet-guiding air in the press.

By using hot air for sheet guidance, the sheet transfer region can take on the function of a drying section, due to which it is unnecessary to use an additional drying unit, for example, between two varnish units, and a more compact structure with attendant cost savings can be attained.

The air guide element can be secured to the press by a hinge, specifically in such a way that it can be folded upwardly out of the way. In this manner, the transfer drum is readily accessible. This makes for better maintenance and cleaning of the press.

Other features which are considered as characteristic for the invention are set forth in the appended claims.

Although the invention is illustrated and described herein as embodied in a sheet-guiding system for a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
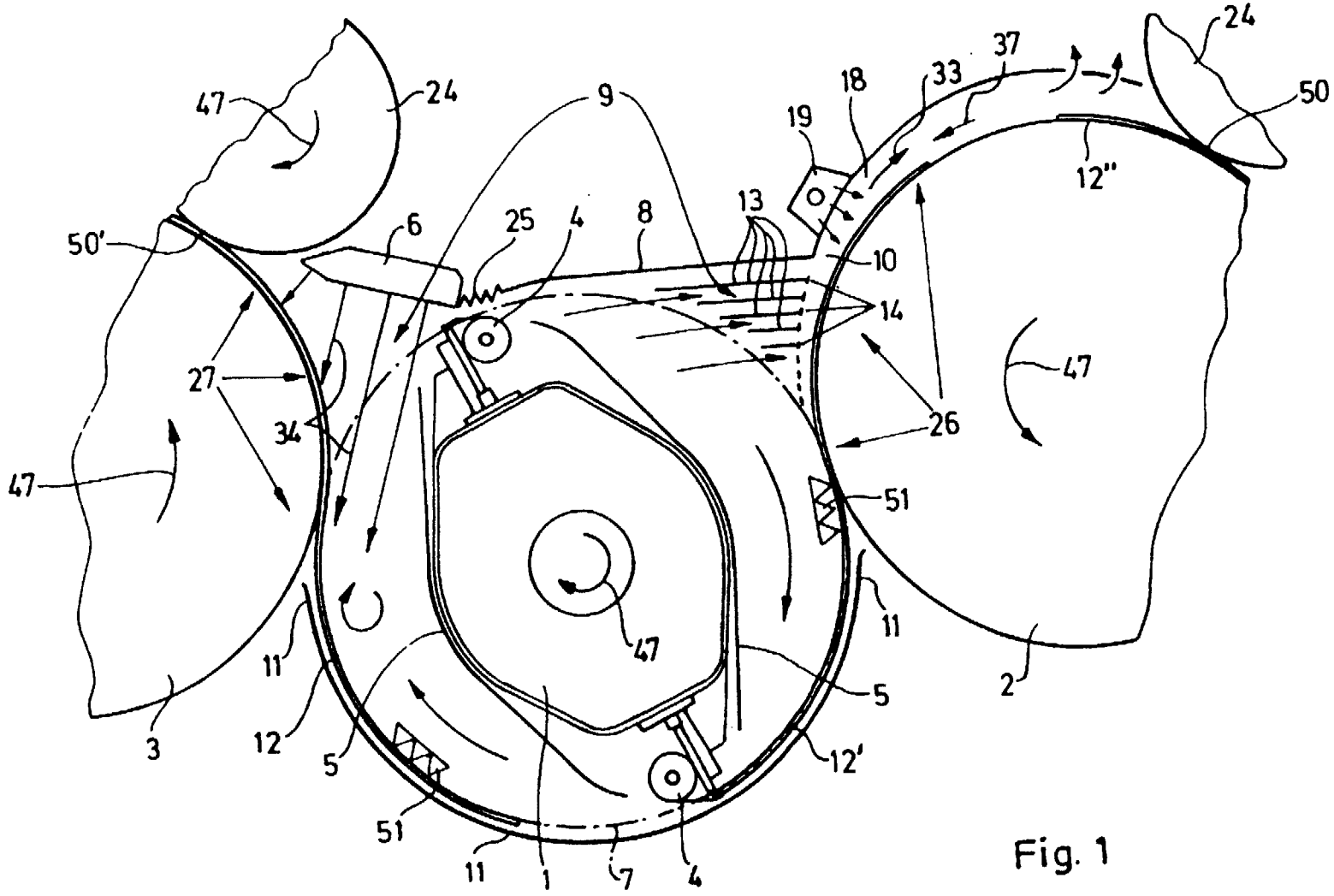
FIG. 1 is a diagrammatic front elevational view of a first exemplary embodiment of the sheet-guiding system according to the invention.

Referring now to the drawings and, first, particularly to FIG. 1 thereof, there is shown therein a first exemplary embodiment of a sheet-guiding system for a printing press, the sheet-guiding system being disposed on a transfer drum 1, which is located between sheet-guiding cylinders 2 and 3, respectively disposed upstream and downstream of the transfer drum 1, as viewed in a travel direction of sheets 12, 12' and 12". In this exemplary embodiment, the sheet-guiding cylinders 2 and 3 are impression cylinders. The transfer drum 1 may, however, also be located between other cylinders, such as varnishing cylinders or drums which serve to pass sheets onward. It is also conceivable to dispose the transfer drum 1 in a sheet-turning device. The sheet-guiding cylinders 2 and 3 in the exemplary embodiment cooperate as impression cylinders with blanket cylinders 24, the sheets 12, 12', 12" being printed in the nip between both cylinders.

The transfer drum 1 is provided with two gripper rows 4. However, the sheet-guiding system is not limited to such a transfer drum 1, it being also possible for three, four or more gripper rows to be provided. What is essential is that closed or virtually closed surfaces 5 exist between the grippers rows 4. Such surfaces are required in order to attain an effect similar to that of a circular piston. The directions of rotation of the cylinders 2, 3 and 24 and of the transfer drum 1 are represented by curved arrows 47. Located above the transfer drum 1 is an air guide element 8, which is spaced slightly apart from the travel path 7 of the gripper rows 4. This spacing must be of such dimension that, in every case, collision-free motion of the transfer drum 1 is assured. The air guide element 8 extends from the upstream sheet-guiding cylinder 2 to the downstream sheet-guiding cylinder 3, although it need not necessarily terminate at the respective cylinder 2 or 3, but instead, can also extend, for example, as far as one of the two blanket cylinders 24. What is essential is that an air chamber 9 be formed, which extends from the upstream sheet-guiding cylinder 2 to the downstream sheet-guiding cylinder 3 and is in essence defined by the cylinders 2 and 3, the transfer drum 1, the air guide element 8, and other non-illustrated lateral walls. This air chamber 9 should be sealed off for the most part, with the exception of an air outlet opening 10, which is located at the end of the air guide element 8 which is directed towards the upstream sheet-guiding cylinder 2. The other end of the air guide element 8 is formed, in this exemplary embodiment, by a blower device 6, which is swivellably disposed on the air guide element 8 by a movable, tight connection 25. Because of this swivellable disposition of the blower device 6, it is possible to adjust the blowing direction of the supplied air represented by straight arrows 34. This supplied air 34 is directed towards a working region 27 of the downstream sheet-guiding cylinder 3 and serves to attain a calm, flutter-free sheet guidance on this cylinder 3. It is essential that the air guide element 8 seal off the air chamber 9 at the top, as well as possible, except for the air outlet opening 10, but the spacings from the moving parts must be maintained inasmuch as they are required for collision-free travel. The sealing off towards the side can be effected by having the air guide element 8 project as closely as possible to the side walls. The cylinders 2, 3 and 24 can also be sealed off by having them project as far as possible to the side walls. The same is true for the transfer drum 1, if lateral sealing disks are disposed thereon. Such disks may be constructed so that they correspond to the travel path 7 of the gripper rows 4, or are only slightly larger than this path. It is also possible for parts of the side walls, for example, those parts thereof located between the rotating parts, to be constructed with an increased height and, in this way, to assure an even better sealing.

Moreover, the sealing can be attained by additional lateral structural components as well, such as plates, baffles, and so forth, which are secured to the side wall.

In the exemplary embodiment shown in FIG. 1, a sheet-guiding device 11 is disposed on the lower side of the transfer drum 1 and is located outside the travel path 7 of the gripper rows 4 so that a sheet 12, 12', 12" can be guided along it as much as possible without the occurrence of any contact therebetween. The sheet-guiding device 11 may be constructed as a closed guide baffle or plate or as a floating guide. In the latter case, it may be a nozzle plate or baffle, which assures that the sheets 12, 12', 12" are guided along on an air cushion. This embodiment is especially advantageous whenever sheets are to be printed on both sides thereof, so that contact with the outside of the sheet must be avoided in every case.

In the exemplary embodiment shown in FIG. 1, an air guiding device 13 is disposed below the air guide element 8, in a region between the travel path 7 of the gripper rows 4 and the upstream sheet-guiding cylinder 2. The air guiding device 13 may, for example, be formed of baffles 14 disposed parallel to the air guide element 8 and extending in a direction towards the upstream sheet-guiding cylinder 2 in order to achieve laminar air flow in this direction. Naturally, other constructions are also conceivable, such as in the form of guide channels, laminated wire grids, or upright guide blades, for example.

The air outlet opening 10 is preferably formed as an air outlet channel 18, as shown in FIG. 1, which extends substantially parallel to the surface of the upstream sheet-guiding cylinder 2, counter to the direction of rotation 47 of the cylinder 2. This air outlet channel 18 serves to produce a damming effect having a pressure which results in good sheet guidance on the upstream sheet-guiding cylinder 2. The damming effect is produced by the waste air 33 emerging from the air outlet channel 18 and meeting the wake or tractive flow 37 of the upstream sheet-guiding cylinder 2. A dryer 19 may additionally be disposed at the air outlet channel 18, and may be in the form of a radiant dryer, which transmits ultraviolet or infrared rays in a direction towards the sheets 12, 12' and 12", or it is also possible to operate the dryer 19 with blown air, warmed blown air, or with radiation and blown air.

In the entire region of the sheet-guiding system, the freshly printed side 51 of the sheet 12, 12', 12" is located in the region of blown and supporting air, respectively. Consequently, good guidance and drying of the sheet 12, 12', 12" between the printing nips 50 and 50' are attained.

FIGS. 2 to 5 serve to explain the function of the sheet-guiding system, a second exemplary embodiment of the invention being shown in these figures. The second exemplary embodiment differs from the first embodiment shown in FIG. 1 in that the air guide element 8 has a bent portion 16, and the baffles 14 which are parallel to the air guide element 8 have bent portions 15. These bent portions 15 and 16 are disposed at an angle so that they extend substantially perpendicularly to the surface of the upstream sheet-guiding cylinder 2, and have the function of guide blades or pressure-increasing vanes and serve to apply air to the sheets 12, 12', 12" on the upstream sheet-guiding cylinder 2.

Figure 2:
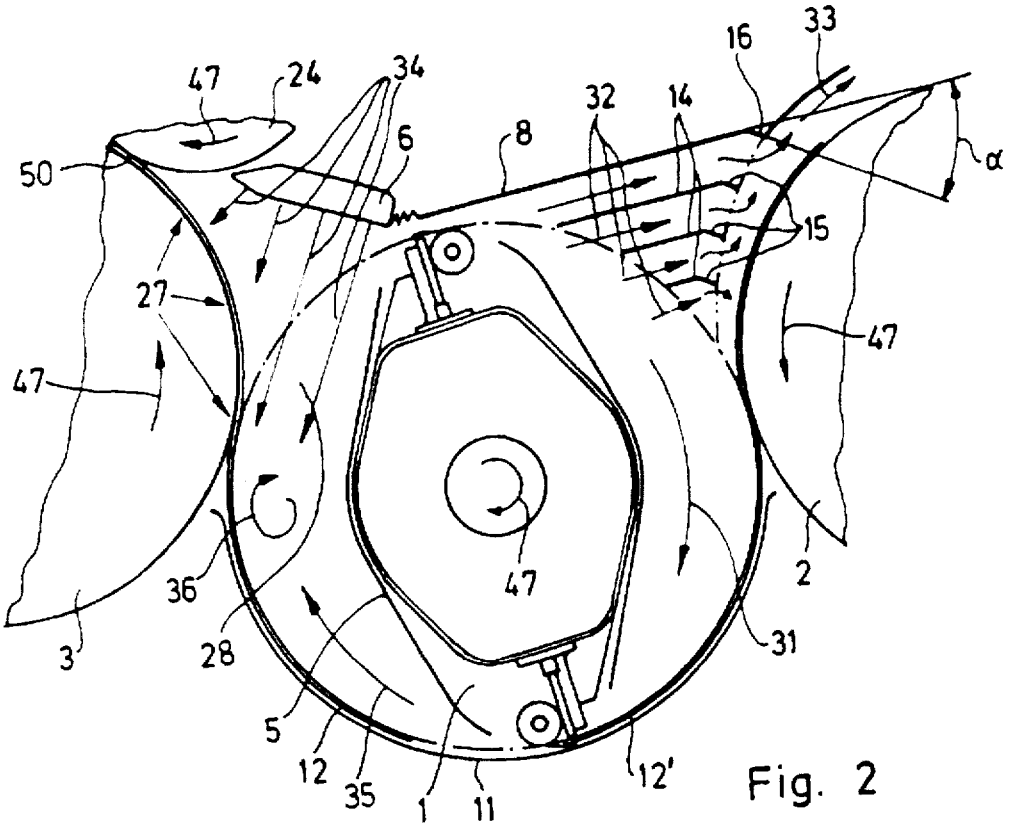
FIGS. 2 to 5 are a front elevational view of a second exemplary embodiment of the sheet-guiding system in four respectively different phases of operation thereof.

FIG. 2 shows the work cycle I, referred to in the introduction hereto, wherein the transfer drum 1, in the operating-phase position shown, together with the blower device 6, the blanket cylinder 24 and the downstream sheet-guiding cylinder 3, forms an air inlet chamber 28. Closure is effected at the bottom by the sheet 12 or, also by a sheet-guiding device 11, if such a device is provided. The blower device 6 acts upon this air inlet chamber 28 with freshly supplied, preferably dry and optionally heated air 34, the air flow being directed towards a working or action region 27 of the downstream sheet-guiding cylinder 3 whereon a sheet 12 is disposed. The air flow is preferably directed counter to the direction of travel of the sheet 12. In this air inlet chamber 28, the supplied air 34 and the sheet-supporting air 35 enclosed between the sheet 12 and the surface 5 meet one another, causing turbulence 36. The air is thus compressed in the chamber volume and, as a result, high compressive forces are exerted upon the sheet in the transfer region between the transfer drum 1 and the downstream sheet-guiding cylinder 3, as well as in the region up to the printing nip 50. A very good application of the sheet to the cylinder 3 is thereby attained. Due to the well-mixed air, further drying of the sheet 12 can also occur, if the supplied air 34 is dry and/or heated air.

Figure 3:
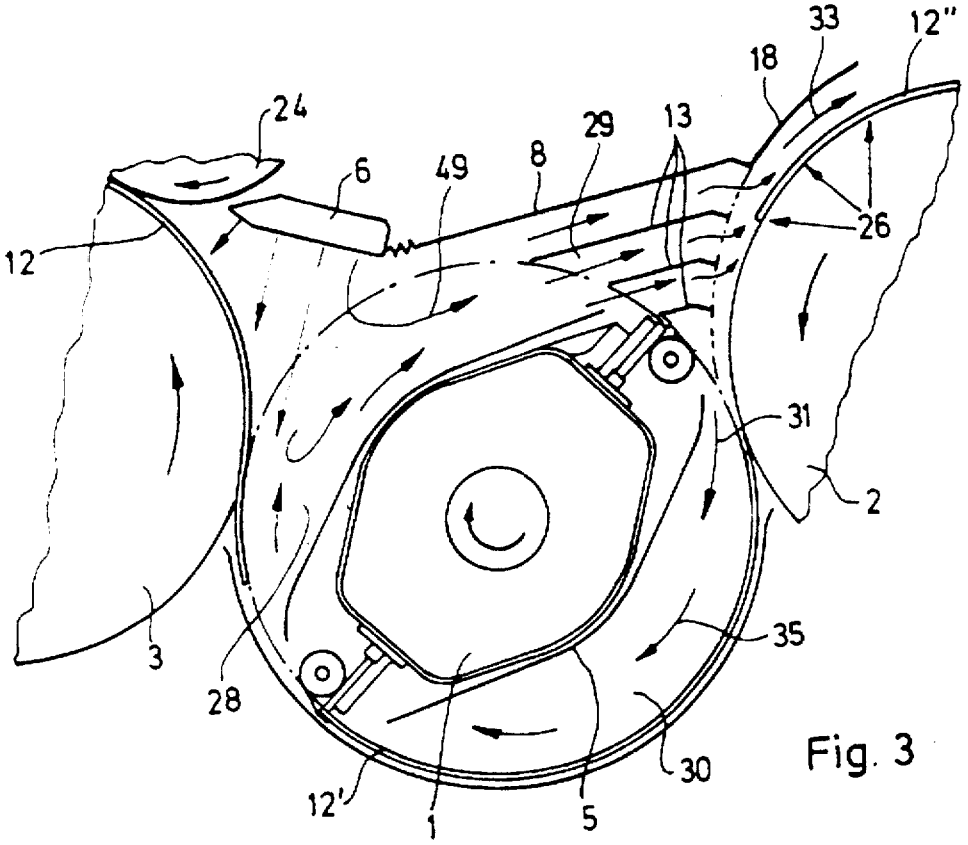

FIG. 3 shows the transfer drum 1 in a phase position after a further rotation, which corresponds to the work cycle II described hereinbefore. In this phase position, the air inlet chamber 28 is opened towards an air outlet channel 29, some of the air flowing out of the air inlet chamber 28 in a direction towards the air outlet channel 29. This outflowing air 49 is guided by the air guiding device 13 to an action or work region 26 of the upstream sheet-guiding cylinder 2, so as to produce good guidance of the sheet 12" thereat. This sheet 12" is fixed by the leading edge thereof likewise with a row of grippers, not shown in FIG. 3, and is stretched and pressed rearwardly by the waste air 33 which flows out through the air outlet channel 18.

Figure 4:
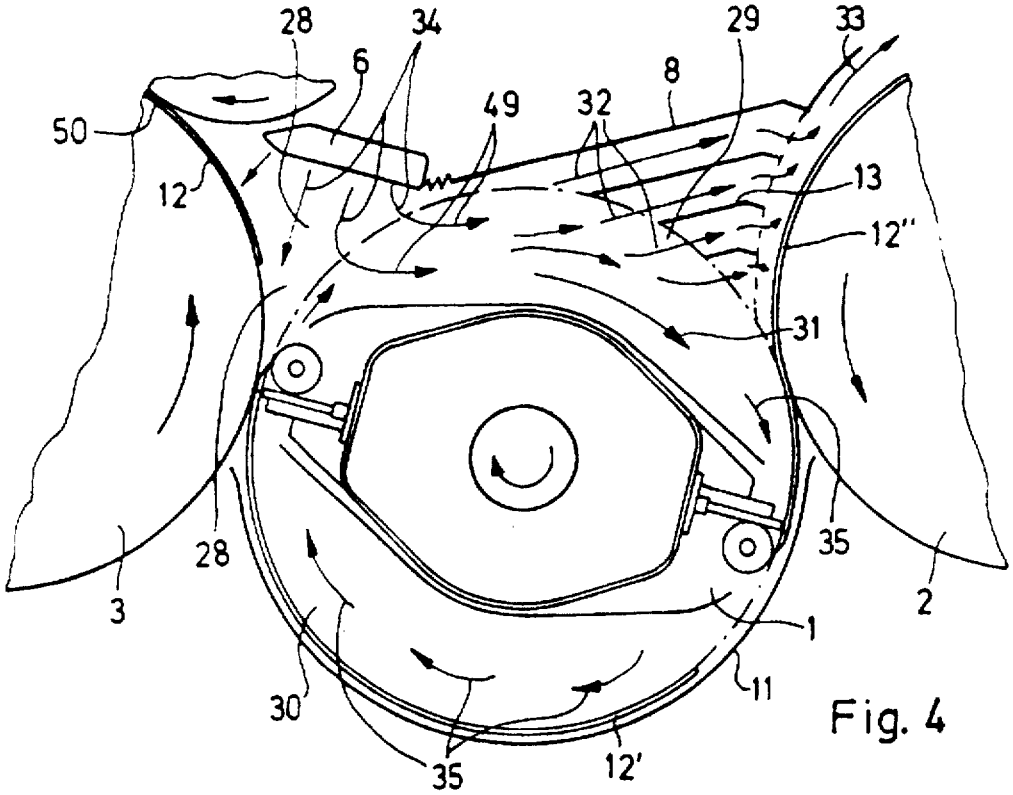

In FIG. 4, the transfer drum 1 has completed a further rotation; at the top, it is in the work cycle III and, at the bottom, it is shown in the work cycle IV attained after a further 180° revolution. The sheet 12 leaves the air inlet chamber 28 in a direction towards the printing nip 50, and the supplied air 34 of the blower device 6 and the sheet-supporting air 35 mixed therewith leave the air inlet chamber 28 in the form of outflowing air 49 in a direction towards the air outlet chamber 29. In the air outlet chamber 29, a first partial flow 31 forms which, as sheet-supporting air 35, places itself between the sheet 12" and the drum 1. A second partial flow 32 is directed by the air guiding device 13 for blowing on the portion of the sheet 12" which remains located on the upstream sheet-guiding cylinder 2.

Figure 5:
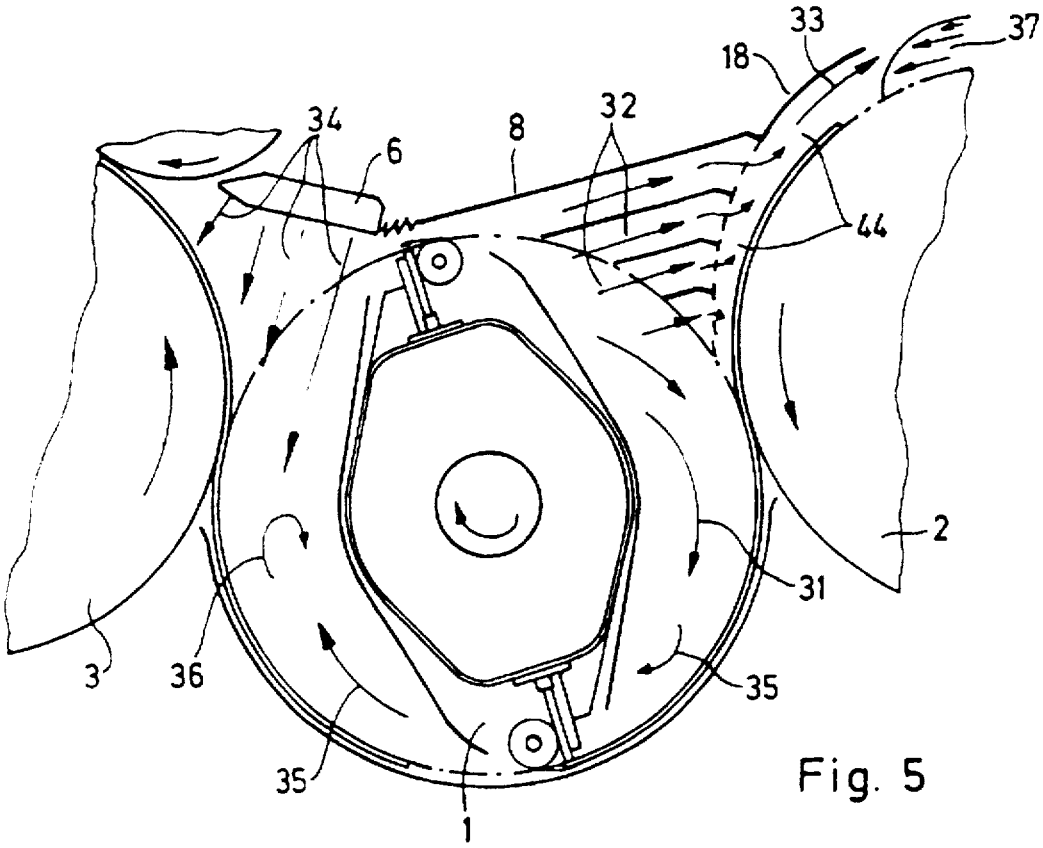

FIG. 5 shows a phase position resulting from a further rotation of the transfer drum 1, by which the first partial flow 31 is reinforced for developing the sheet-supporting air 35. In the development of the first partial flow 31 and the second partial flow 32, an advantageous separation or division of the air ensues, because the drier air has a higher density and, as the first partial flow 31, forms the sheet-supporting air 35. The moist air, conversely, forms the second partial flow 32, which is used for blowing at the sheet 12" and is then removed as waste air 33. Because the sheet 12" on the upstream sheet-guiding cylinder 2 still has a great deal of moisture, the air in the second partial flow 32, despite its moisture, is capable of absorbing additional moisture from the sheet 12". It is of great advantage that the air develops a countercurrent region 44, with respect to the motion of the sheet 12", a strong drying action being attained thereby. After the waste air 33 has emerged from the air outlet channel 18, the waste air 33 meets the wake 37 of the upstream sheet-guiding cylinder 2. Due to this meeting, a pressure increase and an application of pressure to the sheet 12" occur once again. Thereafter, the waste air 33 leaves the press.

If a further rotation of the transfer drum 1 occurs, a phase position again ensues such as has already been shown in FIG. 3 and in the lower part of FIG. 4, and which has been identified as work cycle IV. The air of the first partial flow 31 is located in a sheet-supporting chamber 30, which is formed by the sheet 12' and the surface 5; in this chamber, this air acts as sheet-carrying air 35 for reliable guidance of the sheet 12'. Further drying of the sheet 12' is achieved in the process because, for the most part, the sheet-carrying air 35 is the aforementioned supplied air 34, which has great dryness. The air compressed in the closed chamber 30, moreover, has oscillation-damping influences upon the sheet, because the sheet, as it moves, must press the compressed air together. This stabilizes the sheet, and contactless or contact-free sheet travel is attained. Due to the sheet-guiding device 11, the sheet-supporting chamber 30 remains closed even upon the further rotation to the phase position of the transfer drum 1 shown in FIG. 4, the supporting effect of the pressed-together air being preserved, and even the end of the sheet being reliably guided.

Figure 6:
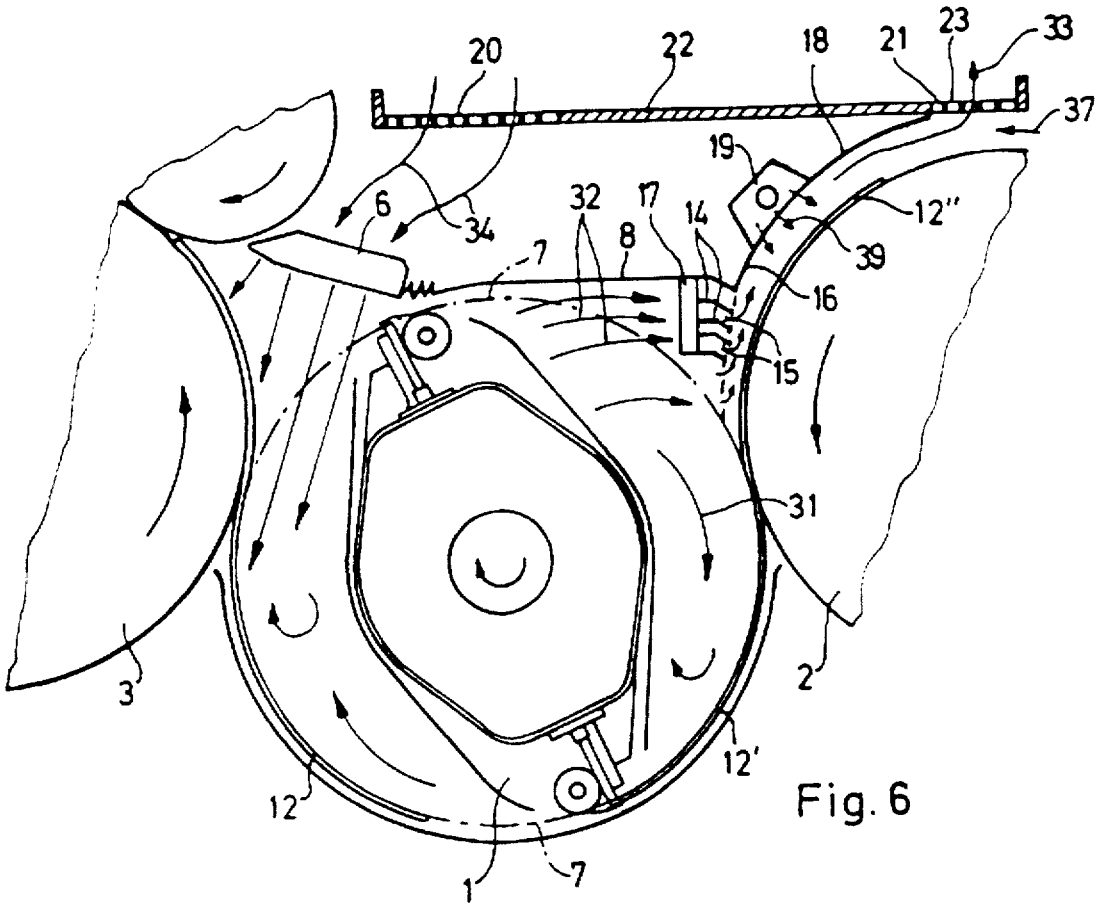
FIG. 6 is a third exemplary embodiment of the sheet-guiding system.

FIG. 6 shows a fourth exemplary embodiment of the sheet-guiding system. In this exemplary embodiment, one additional blower device 17 is disposed below the air guide element 8, between the travel path 7 of the gripper rows 4 and the upstream sheet-guiding cylinder 2. This blower device 17 is directed towards the sheet-guiding cylinder 2 and may, for example, include a row of transversely disposed fans, which lend an additional pressure increase to the overflowing air. The blower device 17 can take the place of the air guiding device 13 or, in cooperation with such a device, can blow against the sheet 12' on the upstream sheet-guiding cylinder 2. In the exemplary embodiment of FIG. 6, the blower device 17 cooperates with baffles 14 located parallel to the air guide element 8, the baffles 14 having a bent portion 15. The air guide element 8 likewise has such a bent portion 16. The waste air 33 flows through the air outlet channel 18, at which a dryer 19 is provided. Thereafter, the waste air 33 arrives at an air outlet 21, which is formed by openings 23 of a footboard 22. The openings 23 form a grid in the footboard 22. An air inlet 20 is also provided in the footboard 22, supplied air 34 reaching the blower device 6 therethrough. The air inlet 20 likewise forms a grid in the footboard 22.

Yet another embodiment of the inventive device is conceivable, wherein the air guide element 8 is formed by the footboard 22; in other words, the air outlet opening 10 shown in FIG. 1 is provided directly in the footboard 22, and the blower device 6 is disposed in the footboard 22, as well.

Figure 7:
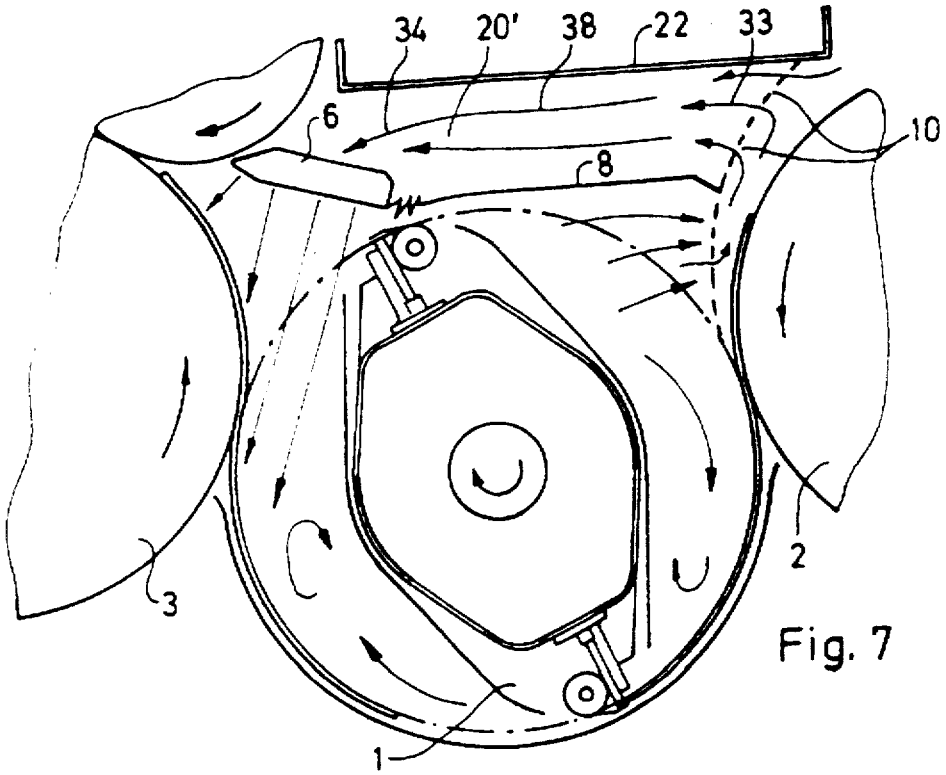
FIG. 7 is a fourth exemplary embodiment of the sheet-guiding system.

FIG. 7 shows a fourth exemplary embodiment of the invention, wherein at least part of the air emerging from the air outlet opening 10 is supplied to the blower device 6 in order to establish an air circulation 38.

Figures 8A, 8B, 8C, 8D, 8E:
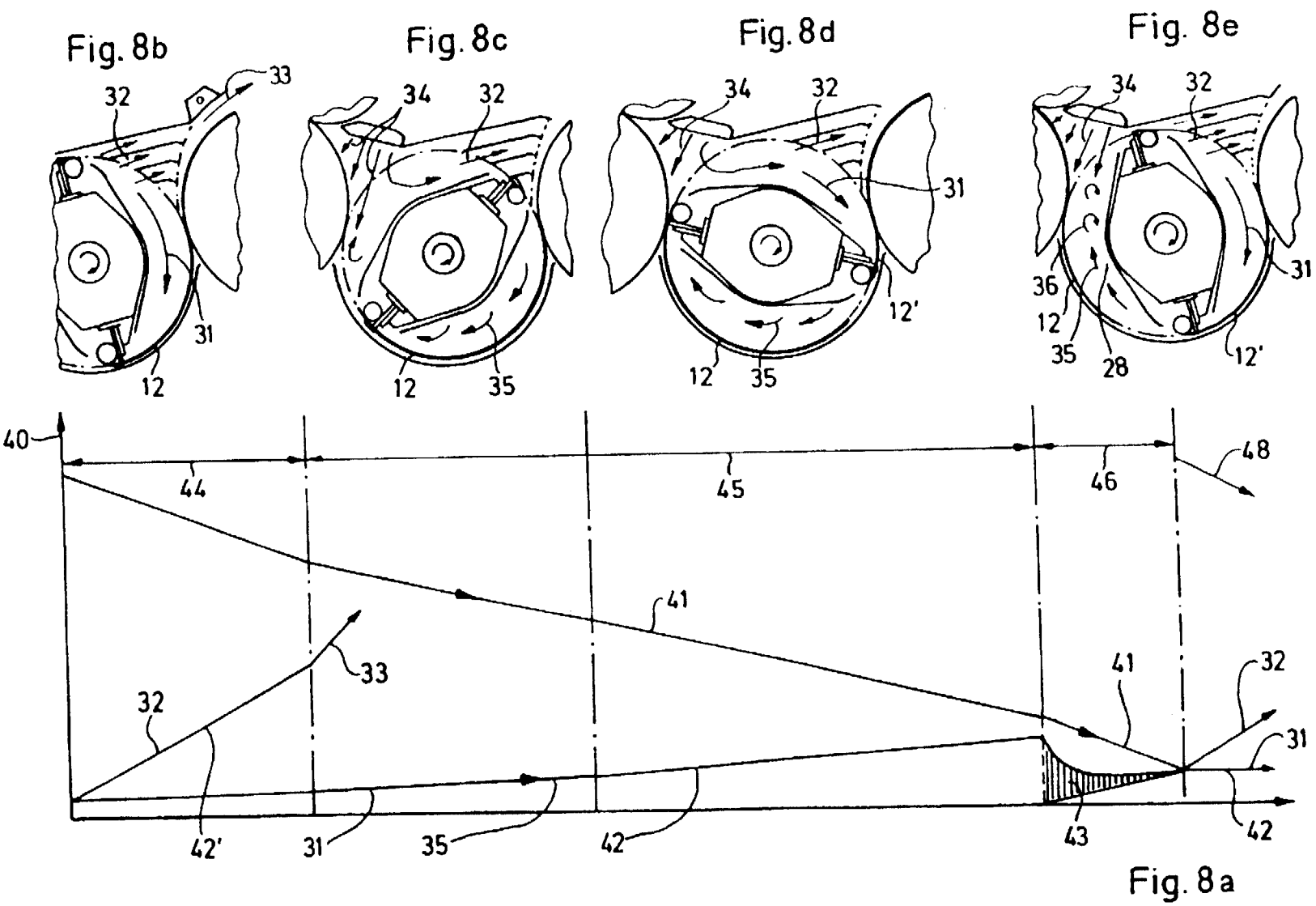
FIG. 8*a* is a plot diagram showing the change in relative moisture of a sheet during the operation of the sheet-guiding system.
FIGS. 8*b* to 8*e* correspond to FIGS. 2 to 5, respectively, and correlate the various phases of operation of the second embodiment of the sheet-guiding system to appropriate sections of the plot diagram of FIG. 8*a*.

FIG. **8*a* shows a plot diagram or graph which illustrates the variation in moisture 41 of the sheet 12, 12', 12" and the relative moisture 42 of the air. Along the horizontal axis or abscissa, a developed view of the path traversed by the sheet 12 is plotted while, along the vertical axis or ordinate, the moisture is plotted, and FIGS. 8*b* to 8*e* show the various phase positions of the sheet guidance system corresponding to those of FIGS. 2 to 5, respectively. FIG. 8*b* shows the phase position after the transfer of a sheet 12 to the transfer drum 1 (work cycle III), wherein the air flows divide or split into a first partial flow 31 and a second partial flow 32. Air is applied to the sheet 12 in the countercurrent region 44 of FIG. 8*a*, i.e., the air flows counter to the sheet transport direction. The second partial flow 32, after this blowing action, becomes waste air 33, and the first partial flow 31, having less moisture, becomes the sheet-supporting air 35. Due to the air blown at the sheet 12 in the countercurrent region 44, drying of the very wet sheet having the moisture 41 thereat is attained, despite the relative moisture 42', because an adequate moisture gradient exists. Thereafter, the sheet reaches the direct or forward-flow region 45 of work cycle IV, which corresponds to the phase positions of FIGS. 8*c* and 8*d*. The relatively dry sheet-supporting air 35 with the relative moisture 42 in addition to the guiding action thereof, assures further drying of the sheet 12. After further rotation of the transfer drum 1** to the phase position of FIG. 8*e*, the air inlet chamber 28 is created (work cycle I), due to which an addition of fresh air 43 is provided by the supplied air 34, thus greatly reducing the relative moisture 42 of the air. The moisture-absorbing capacity thereof thereby rises again, and the residual moisture remaining until then is extracted from the sheet 12. The sheet 12 can then emerge dry from the transfer drum region and be fed for further printing. Once again, a following sheet, namely the sheet 12' having the moisture quantity 48, enters the transfer drum region, and the aforedescribed sequence begins again from the beginning.

I claim:

1. A sheet-guiding system for a printing press, the sheet-guiding system being disposed in the vicinity of a transfer drum located between two sheet-guiding cylinders, respectively, disposed upstream and downstream of the transfer drum, as viewed in a sheet travel direction, the transfer drum being provided with rows of grippers movable along a travel path and having at least nearly closed surfaces between the rows of grippers, comprising an air guide element disposed above the transfer drum at a slight spacing from the travel path of the gripper rows, said air guide element defining an air chamber at the top thereof, said air chamber extending from the upstream to the downstream sheet-guiding cylinder, and a blower device for applying air to said air chamber in a direction towards the downstream sheet-guiding cylinder for assisting in a sheet transfer between the transfer drum and the downstream sheet-guiding cylinder.

2. The sheet-guiding system according to claim 1, wherein, between said air guide element and the upstream sheet-guiding cylinder, an air outlet opening is provided.

3. The sheet-guiding system according to claim 1, wherein said blower device is disposed on said air guide element.

4. The sheet-guiding system according to claim 3, wherein said blower device is adjustably oriented with respect to the downstream sheet-guiding cylinder.

5. The sheet-guiding system according to claim 1, including a heating source for heating the air applied to the air chamber so as to aid in drying the air.

6. The sheet-guiding system according to claim 1, wherein at least part of the travel path of the gripper rows is in a lower region of the transfer drum, and including a sheet-guiding device extending from the upstream sheet-guiding cylinder to the downstream sheet-guiding cylinder along said part of the travel path of the gripper rows in said lower region of the transfer drum.

7. The sheet-guiding system according to claim 6, wherein said sheet-guiding device is a closed guide baffle.

8. The sheet-guiding system according to claim 6, wherein said sheet-guiding device is a floating guide.

9. The sheet-guiding system according to claim 2, including an air guiding device aligned in a direction towards the upstream sheet-guiding cylinder, said air guiding device being disposed below said air guide element and between the travel path of the gripper rows and the upstream sheet-guiding cylinder.

10. The sheet-guiding system according to claim 9, wherein said air guiding device is formed of baffles disposed parallel to said air guide element, said baffles being formed with bent end portions directed towards the upstream sheet-guiding cylinder.

11. The sheet-guiding system according to claim 9, wherein said air guide element is formed with a bent portion directed towards the upstream sheet-guiding cylinder.

12. The sheet-guiding system according to claim 9, wherein said air guiding device is formed as a laminated grid.

13. The sheet-guiding system according to claim 1, including an additional blower device oriented in a direction towards the upstream sheet-guiding cylinder and disposed below said air guide element between the travel path of the gripper rows and the upstream sheet-guiding cylinder.

14. The sheet-guiding system according to claim 2, wherein the air outlet opening is formed as an air outlet channel.

15. The sheet-guiding system according to claim 14, including a dryer disposed in said air outlet channel.

16. The sheet-guiding system according to claim 15, wherein said dryer is a radiant dryer.

17. The sheet-guiding system according to claim 15, wherein said dryer has a blower.

18. The sheet-guiding system according to claim 1, wherein the transfer drum has lateral sealing disks.

19. The sheet-guiding system according to claim 1, wherein a footboard is located at the top of the sheet-guiding system.

20. The sheet-guiding system according to claim 19, wherein said footboard is simultaneously an air guide element.

21. The sheet-guiding system according to claim 19, wherein said footboard is formed with an opening serving as an air inlet leading to said blower device.

22. The sheet-guiding system according to claim 19, wherein an air outlet opening is located between said air guide element and the upstream sheet-guiding cylinder, and said footboard is formed with an air outlet downstream from the air outlet opening.

23. The sheet-guiding system according to claim 2, wherein the air outlet opening is in communication with said blower device for feeding thereto air emerging from the air outlet opening.

24. The sheet-guiding device according to claim 1, wherein a rotation of the transfer drum creates an air flow counter to an air flow provided by said blower causing a turbulent air region, said turbulent air region creating compressive forces exerting against a sheet being transferred between the transfer drum and the downstream sheet-guiding cylinder.

* * * * *